US006081170A

United States Patent [19]

Enokuma

[11] Patent Number: 6,081,170

[45] Date of Patent: Jun. 27, 2000

[54] DUAL FREQUENCY PRIMARY RADIATOR

[75] Inventor: Shunji Enokuma, Osakasayama, Japan

[73] Assignee: Sharp Kabushiki Kaisha, Osaka, Japan

[21] Appl. No.: 09/145,239

[22] Filed: Sep. 1, 1998

[30] Foreign Application Priority Data

Sep. 1, 1997 [JP] Japan ..... 9-235952

[51] Int. Cl.[7] ..... H01D 5/12

[52] U.S. Cl. ..... 333/134; 333/21 A; 333/135; 343/776; 343/786

[58] Field of Search ..... 333/126, 134, 333/135, 21 A; 343/776, 786

[56] References Cited

U.S. PATENT DOCUMENTS 4,998,113 3/1991 Raghavan et al. ..... 343/776
5,793,334 8/1998 Anderson et al. ..... 333/126 X

FOREIGN PATENT DOCUMENTS 63-39206 2/1988 Japan .

*Primary Examiner*—Paul Gensler

[57] ABSTRACT

Provided coaxially inside a first waveguide is a second waveguide, so as to form a coaxial waveguide. The first waveguide for the passage of a low-frequency band signal ($f_L$ signal) functions as the outer conductor of the coaxial waveguide while the second waveguide for the passage of a high-frequency band signal ($f_H$ signal) serves as the center conductor of the coaxial waveguide. Feeders for $f_L$ are provided so that they penetrate through the wall of the first waveguide. Feeders for $f_H$ are provided so that they penetrate through both the first and the second waveguide walls. The distance between the first $f_L$ feeder and the first $f_H$ feeder and the distance between the second $f_L$ feeder and the second $f_H$ feeder are set at approximately one quarter of the wavelength of the $f_L$ signal. The distance between the first $f_H$ feeder and a reflector surface is also set at about one quarter of the wavelength. A reflecting bar is provided inside the second waveguide and located at a position about one quarter of the wavelength away from the second $f_H$ feeder toward the reflector surface.

3 Claims, 4 Drawing Sheets

DUAL FREQUENCY PRIMARY RADIATOR

BACKGROUND OF THE INVENTION (1) Field of the Invention

The present invention relates to a dual frequency primary radiator, such as a parabolic antenna etc., which can handle two frequencies with two components of polarization.

(2) Description of the Prior Art

As a parabolic antenna which can handle two different frequencies, a type as shown in FIGS. 1 and 2 has been conventionally known. FIG. 1 is an overall view of the parabolic antenna, and FIG. 2 is an enlarged view of a dual frequency primary radiator. In the following description, the lower frequency band of two different frequencies will be referred to as $f_L$, and the higher frequency band will be referred to as $f_H$.

The antenna shown in FIG. 1 has a dual frequency primary radiator 110, positioned at the focal point of a parabolic reflector 100. This primary radiator 110 is composed of, as shown in FIG. 2, an $f_L$ primary radiator 101 and an $f_H$ primary radiator 102 with waveguides 103 and 104. Waveguides 103 and 104 have feedhorns 111 and 112, respectively at their one end, forming cone-shaped openings, and have plate-like reflecting means 107 and 108 enclosing the other end thereof. The $f_H$ waveguide 104 is arranged concentrically inside the $f_L$ waveguide 103. An $f_L$ coaxial/waveguide conversion feeder 105 is provided for $f_L$ waveguide 103 and an $f_H$ coaxial/waveguide conversion feeder 106 is provided for $f_H$ waveguide 104.

Referring to FIG. 2, consider a case where a radiowave is transmitted from the antenna. An $f_H$ signal from a transmitter is fed to waveguide 104 from feeder 106 via a coaxial cable line so that the signal is radiated into space from primary radiator 102, which is in turn is reflected by the parabolic reflector and then transmitted. On the other hand, a received $f_L$ signal is input to a primary radiator 101 through the parabolic reflector and then the signal, passing through waveguide 103 and feeder 105, enters the receiver, where the received signal can be picked up.

Waveguide 103 allowing the passage of the $f_L$ signal serves as the outer conductor of the coaxial waveguide, and waveguide 104 allowing the passage of the $f_H$ signal functions as the central conductor for waveguide 103. Concerning coaxial-waveguide conversion feeders, in the case where $f_L$ and $f_H$ frequencies are of single polarization, $f_L$ and $f_H$ feeders 105 and 106 are provided one for each frequency and positioned 90° apart from each other in order not to interfere with each other.

When each of frequencies $f_L$ and $f_H$ is of two types of polarization (i.e., horizontal/vertical polarization for linearly polarized waves, right-hand and left-hand circular polarization for circularly polarized waves), two coaxial-waveguide conversion feeders for each of frequencies $f_L$ and $f_H$ need to be provided in an orthogonal manner as shown in FIG. 3. More specifically, when the transmission or received signal is of a linearly polarized wave, $f_L$ feeder 105V for vertical polarization, $f_L$ feeder 105H for horizontal polarization and $f_H$ feeder 106V for vertical polarization and $f_H$ feeder 106H for horizontal polarization are needed. Concerning $f_H$ feeders 106V and 106H, in order to set the characteristic impedance of the feeder at 50 Ω, in portions other than $f_H$ waveguide 104, they need to have a coaxial cable configuration.

This coaxial cable configuration is composed of a center conductor 151, an insulator 152 and an outer conductor 153 coaxially arranged in this order as shown in FIG. 4, and the characteristic impedance will be determined depending upon the outside diameter of the center conductor, the inside diameter of the outer conductor and the dielectric constant of the insulating material.

A feeder for transforming a coaxial line into a waveguide needs a reflecting means (designated at 107 and 108, as shown in FIG. 3) which is disposed at a distance therefrom of about one quarter of a guide wavelength (λg/4) in the direction opposite the signal propagating direction. The reflecting means 107 and 108 are plates for enclosing the waveguides, as shown in FIG. 3. It is also possible to provide a bar-shaped reflecting means 109, as shown in FIG. 5, which is arranged in parallel with the electric field component of the signal. The reflecting means need be formed of a conductive material so as to provide electric connection with the waveguide.

In the above case, two coaxial/waveguide conversion feeders arranged orthogonally are needed. In this configuration shown in FIG. 3, for signal transmission, an $f_L$ signal from $f_L$ feeder 105V will be reflected by the outer conductor of $f_H$ feeder 106V, and an $f_L$ signal from $f_L$ feeder 105H is reflected by the outer conductor of $f_L$ feeder 106H, so that the two $f_L$ signals cannot reach feedhorn 111. For signal reception, an $f_L$ signal from feedhorn 111 will be reflected by the outer conductors of $f_H$ feeders 106V and 106H so that the signal cannot reach either $f_L$ feeders 105V or 105H. This situation will be also the same in the case where $f_H$ feeder 106V is provided opposite $f_L$ feeder 105V (180° apart) as shown in FIG. 6.

SUMMARY OF THE INVENTION

It is therefore an object of the present invention to provide a dual frequency primary radiator, which can handle two frequencies of radiowaves with two components of polarization, and receive and transmit their signals in an efficient manner.

The present invention has been devised in order to achieve the above object, so the present invention is configured as follows:

In accordance with the first aspect of the invention, a dual frequency primary radiator for receiving, transmitting, or receiving and transmitting, two frequencies of radiowaves having two components of polarization, comprises:

a coaxial waveguide, composed of a first-frequency waveguide and a second-frequency waveguide arranged inside and substantially coaxially with the first-frequency waveguide, and opening at one end thereof for forming the radiator means;

a pair of first-frequency feeders for individual polarized waves of a first frequency, provided penetrating through the wall of the first-frequency waveguide to reach the interior of the first-frequency waveguide, and a pair of second-frequency feeders for individual polarized waves of a second frequency, provided penetrating through the walls of the first-frequency and second-frequency waveguides to reach the interior of the second-frequency waveguide, the feeders each being composed of an outer conductor, and a center conductor arranged inside and concentrically with the outer conductor; and a reflecting means provided inside the second-frequency waveguide, at a position approximately one quarter of the wavelength away from the second-frequency feeder in the direction opposite the radiator means, characterized in that the first-frequency feeders are located at positions approximately one quarter of the wavelength away from the second-frequency feeders toward the radiator means of the coaxial waveguide, and the outer conductors of the second-frequency feeders are utilized as the reflecting means for the first-frequency feeders.

Next, in accordance with the second aspect of the invention, the dual frequency primary radiator having the above first feature is characterized in that the first-frequency waveguide and the second-frequency waveguide are concentric circular waveguides.

In accordance with the third aspect of the invention, the dual frequency primary radiator having the above first feature is characterized In that the first-frequency waveguide and the second-frequency waveguide are rectangular waveguides having square or rectangular cross-sections, arranged substantially concentrically about the same center.

The operation of the invention will be described.

For signal radiation from this primary radiator, the signal supplied from the first-frequency feeder to the first-frequency waveguide is radiated from the radiator, with the help of the outer conductor of the second-frequency feeder as a reflecting means. The signal supplied from the second-frequency feeder to the second-frequency waveguide is reflected by the reflecting means and radiated from the radiator. For a case of signal reception, the signals entering the first-frequency waveguide and the second-frequency waveguide through the radiator, directly reach the first-frequency feeder and the second-frequency feeder.

In this way, unlike the prior art, outer conductors of the first-frequency and second-frequency feeders are located at positions where the feed of the signal will not be interfered with. Further, the outer conductor of the second-frequency feeder is used as the reflecting means. So, it is possible to achieve efficient signal feed.

DESCRIPTION OF THE PREFERRED EMBODIMENTS

The embodiment of the invention will hereinafter be described with reference to the accompanying drawings.

Figure 1:
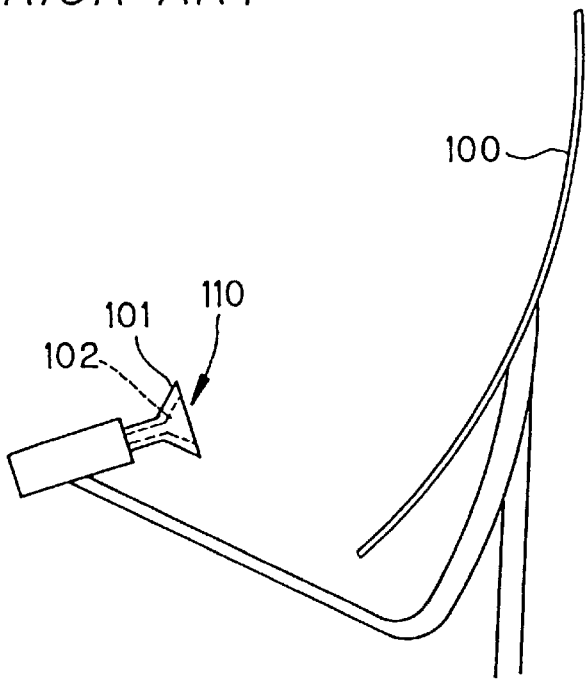
FIG. 1 PRIOR ART
FIG. 1 is an overall view showing a conventional parabolic antenna.
Figure 2:
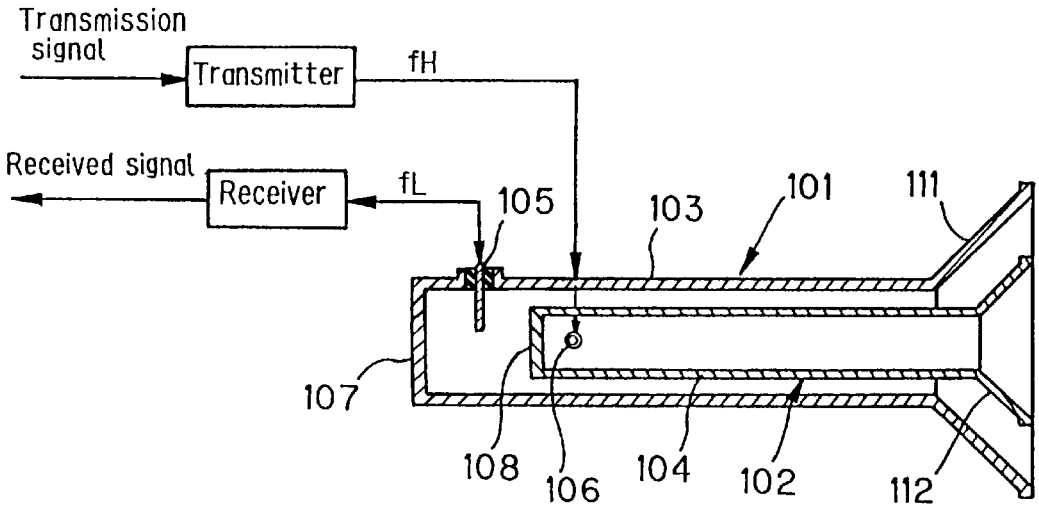
FIG. 2 PRIOR ART
FIG. 2 is an enlarged sectional view showing a conventional dual frequency primary radiator.
Figure 3:
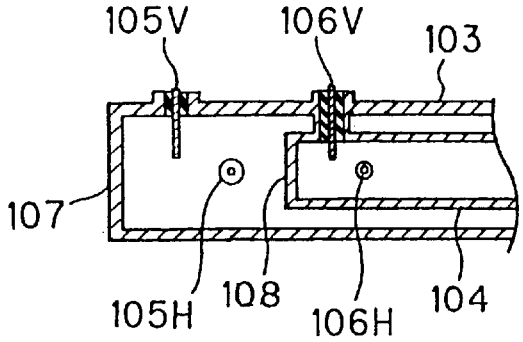
FIG. 3 PRIOR ART
FIG. 3 is an enlarged sectional view showing a conventional dual frequency primary radiator which can also receive and transmit two components of polarization.
Figure 4:
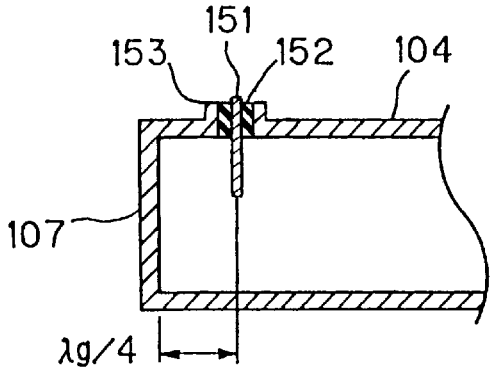
FIG. 4 PRIOR ART
FIG. 4 is an enlarged sectional view showing the position of a plate-like reflecting means in a dual frequency primary radiator.
Figure 5:
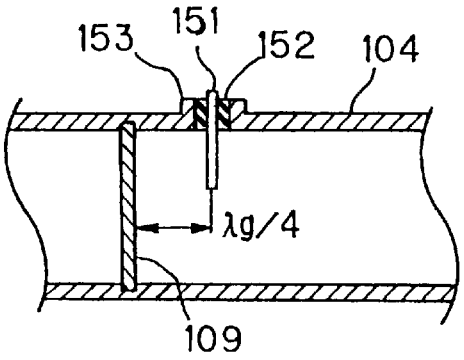
FIG. 5 PRIOR ART
FIG. 5 is an enlarged sectional view showing the position of a bar-like reflecting means in a dual frequency primary radiator.
Figure 6:
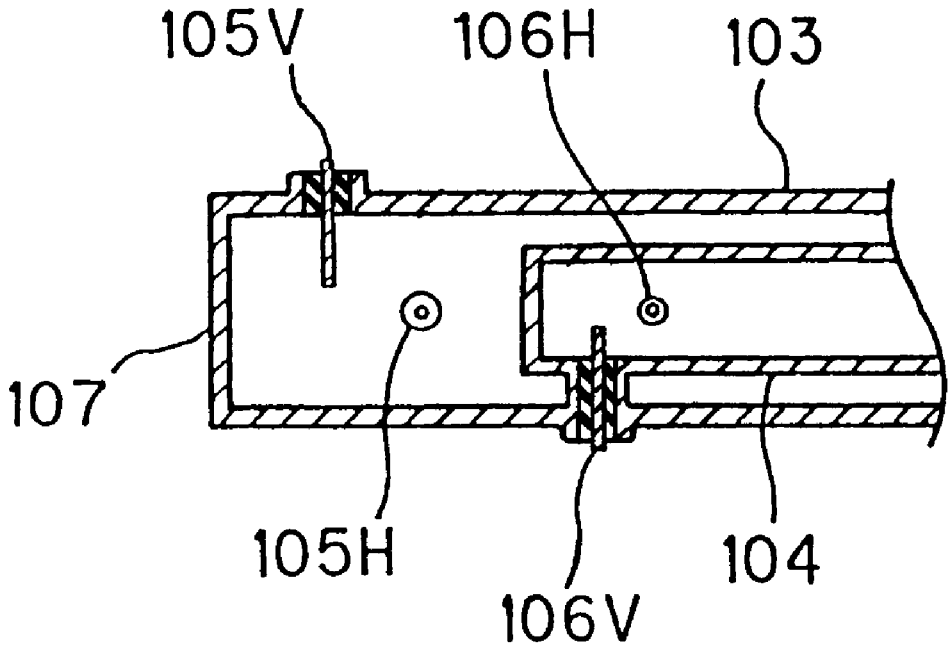
FIG. 6 PRIOR ART
FIG. 6 is an enlarged sectional view showing a dual frequency primary radiator in which $f_H$ feeders are provided 180° opposite $f_L$ feeders.
Figure 7:
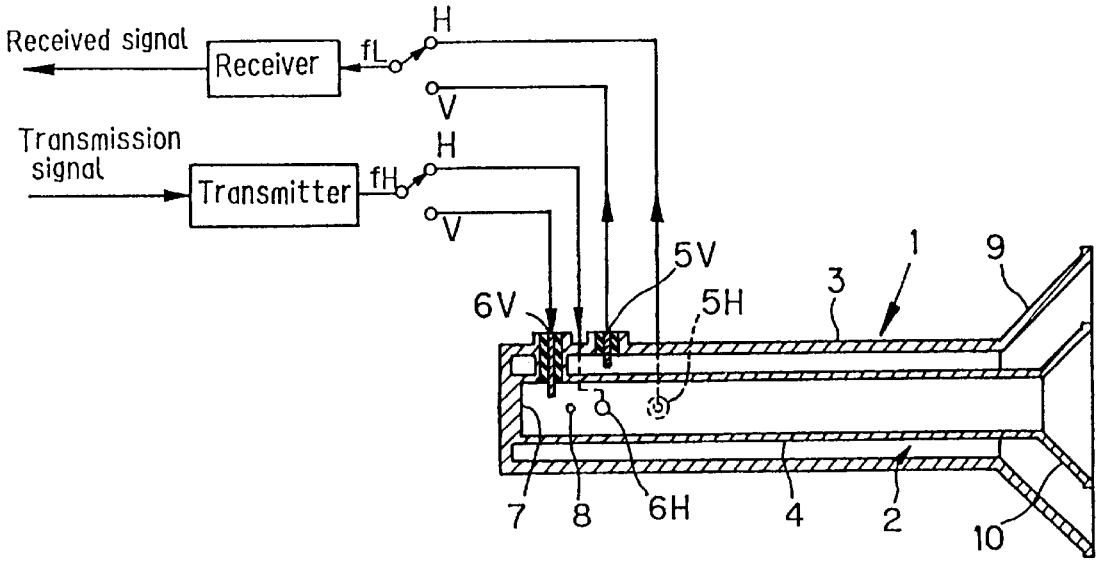
FIG. 7 is a sectional view showing a dual frequency primary radiator in accordance with the invention.
Figure 8:
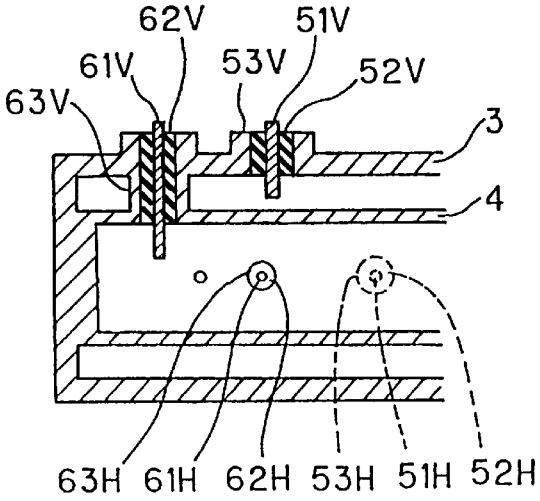
FIG. 8 is an enlarged sectional view showing the portion including the feeders of the dual frequency primary radiator.

FIG. 7 is a sectional view showing a dual frequency primary radiator in accordance with the invention, and FIG. 8 is an enlarged view showing the portion including the feeders thereof.

This dual frequency primary radiator comprises a primary radiator 1 for the first frequency, namely, $f_L$ and a primary radiator 2 for the second frequency, namely $f_H$. These primary radiators 1 and 2 include the first and second waveguides 3 and 4, the first and second feeders 5V and 5H for the first frequency $f_L$ and the first and second feeders 6V and 6H for the second frequency $f_H$.

Second waveguide 4 is arranged inside, and approximately coaxially with first waveguide 3, forming a coaxial waveguide. First waveguide 3 for the passage of an $f_L$ signal will serve as the outer conductor of the coaxial waveguide while second waveguide 4 for the passage of an $f_H$ signal serves as the center conductor of coaxial waveguide 3. First and second waveguides 3 and 4 have feedhorns 9 and 10, respectively at their one end, forming cone-shaped openings, and have a plate-like reflector surface 7 enclosing the other end of them both. Feedhorns 9 and 10 function to radiate signals to a parabolic reflector of the antenna. Reflector surface 7 functions to reflect signals propagating with respect to the direction opposite feedhorns 9 and 10.

Concerning the configurations of feeders 5V, 5H, 6V and 6H, each feeder has an coaxial cable configuration in which a center conductor 51V, 51H, 61V or 61H, and an insulator 52V, 52H, 62V or 62H, and an outer conductor 53V, 53H, 63V or 63H, are coaxially arranged in this order of sequence, as shown in FIG. 8. First and second $f_L$ feeders 5V and 5H penetrate through the wall of first waveguide 3, reaching the interior of first waveguide 3. First and second $f_H$ feeders 6V and 6H, penetrate through the walls of first and second waveguides 3 and 4, reaching the interior of second waveguide 4. Center conductors 51V and 51H are provided so as project inside first waveguide 3, and center conductors 61V and 61H are provided so as to project inside second waveguide 4. Center conductors 51V and 51H are connected to the receiver via coaxial cables. Center conductors 61V and 61H are connected to the transmitter via coaxial cables.

The distance between first $f_L$ feeder 5V and first $f_H$ feeder 6V is set at about one quarter of the wavelength of the $f_L$ signal. Similarly, the distance between second $f_L$ feeder 5H and second $f_H$ feeder 6H is set at about one quarter of the wavelength of the $f_L$ signal. The distance between first $f_H$ feeder 6V and reflector surface 7 is also set at about one quarter of the wavelength. A reflector bar 8 is provided inside second waveguide 4, at a position about one quarter of the wavelength toward reflector surface 7 from second $f_H$ feeder 6H.

For various reasons, it is considered to be advantageous if the first and second waveguides used in this invention are substantially concentrically arranged circular waveguides, but the invention will not be limited to this, so the waveguides may be of square or rectangular form in cross section, arranged substantially concentrically about the same center.

Referring next to FIG. 7, a case of transmitting radiowaves from the antenna will be considered. An $f_H$ signal from the transmitter is supplied to second waveguide 4 via feeder 6H or 6V, by selecting either H or V depending upon either horizontal polarization transmission or vertical polarization transmission. At this time, the $f_L$ signal from $f_L$ feeder 5V is reflected by outer conductor 63V, and the signal from $f_H$ feeder 6V is reflected by reflector surface 7. The $f_L$ signal from $f_L$ feeder 5H is reflected by outer conductor 63H of $f_H$ feeder 6H, and the signal from $f_H$ feeder 6H is reflected by reflecting bar 8. Thus, the signals propagating in the direction opposite feedhorns 9 and 10 can be reflected thus making it possible to radiate the signals more efficiently. As another example, two separate transmission signals may be supplied simultaneously to feeders 6H and 6V, so as to feed both the horizontal and vertical components of polarization, to second waveguide 4.

An $f_L$ received signal is input to primary radiator 1 and then is introduced to the feeder via first waveguide 3. The $f_L$ received signal is fed to and picked up by either feeder 5H or 5V, that is, if the signal is of a horizontal polarization, it is supplied to feeder 5H while the signal is supplied to feeder 5V if it is of a vertical polarization. In this case, unlike the prior art, no outer conductors of the feeders will interfere with the propagation of the signal, so that it is possible to efficiently supply the signals to the predetermined feeders. There is another example, in which two different signals may be received as horizontally and vertically polarized waves and supplied via respective feeders 5H and 5V to two receivers.

As still another example, both $f_L$ and $f_H$ signals, each having horizontal and vertical components of polarization, may be used as the received signals. In this case, in total, four types of signals can be received.

In accordance with the invention, for transmission, the outer conductor of the second frequency feeder can be used as the reflecting means of the first frequency feeder. For reception, the outer conductor is located away from a position where it will interfere with the received signal. In this way, it is possible to realize a primary radiator which can handle two frequencies of radiowaves with two components of polarization.

What is claimed is:

1. A dual frequency primary radiator for receiving, transmitting, or receiving and transmitting, two frequencies of radiowaves having two components of polarization, comprising:

a coaxial waveguide, composed of a first-frequency waveguide and a second-frequency waveguide arranged inside and substantially coaxially with the first-frequency waveguide, and opening at one end thereof for forming the radiator means;

a pair of first-frequency feeders for individual polarized waves of a first frequency, provided penetrating through the wall of the first-frequency waveguide to reach the interior of the first-frequency waveguide, and a pair of second-frequency feeders for individual polarized waves of a second frequency, provided penetrating through the walls of the first-frequency and second-frequency waveguides to reach the interior of the second-frequency waveguide, the feeders each being composed of an outer conductor, and a center conductor arranged inside and concentrically with the outer conductor; and a reflecting means provided inside the second-frequency waveguide, at a position approximately one quarter of the wavelength away from the second-frequency feeder in the direction opposite the radiator means, characterized in that the first-frequency feeders are located at positions approximately one quarter of the wavelength away from the second-frequency feeders toward the radiator means of the coaxial waveguide, and the outer conductors of the second-frequency feeders are utilized as the reflecting means for the first-frequency feeders.

2. The dual frequency primary radiator according to claim 1, wherein the first-frequency waveguide and the second-frequency waveguide are concentric circular waveguides.

3. The dual frequency primary radiator according to claim 1, wherein the first-frequency waveguide and the second-frequency waveguide are rectangular waveguides having square or rectangular cross-sections, arranged substantially concentrically about the same center.

* * * * *

UNITED STATES PATENT AND TRADEMARK OFFICE

CERTIFICATE OF CORRECTION

PATENT NO. : 6,081,170
DATED : June 27, 2000
INVENTOR(S) : Shunji Enokuma

It is certified that error appears in the above-identified patent and that said Letters Patent is hereby corrected as shown below:

Claim 1
Line 9, change "the" to -- a -- and delete "means".
Line 12, change "the" (first occurrence) to -- a --.
Line 13, change "the" (first occurrence to -- an --.
Line 16, delete "the" (first occurrence).
Line 17, change "the" (first occurrence) to -- an --.
Line 22, change "reflecting means" to -- reflector --.
Line 24, change "the" (first occurrence) to -- a --.
Line 25, change "the" (first occurrence to -- a --.
Lines 25 and 26, change" means, characterized in that" to -- , wherein --.
Line 29, delete "means".
Line 31, change "the reflecting means" to -- a reflector --.

Claim 3
Line 5, change "the" to -- a --.

Signed and Sealed this

Twenty-first Day of August, 2001

*Attest:*

Nicholas P. Godici

NICHOLAS P. GODICI
*Acting Director of the United States Patent and Trademark Office*

*Attesting Officer*